US006659053B1

(12) United States Patent
Cecur

(10) Patent No.: US 6,659,053 B1
(45) Date of Patent: Dec. 9, 2003

(54) FULLY VARIABLE VALVE TRAIN

(75) Inventor: Majo Cecur, Marshall, MI (US)

(73) Assignee: Eaton Corporation, Cleveland, OH (US)

( * ) Notice: Subject to any disclaimer, the term of this patent is extended or adjusted under 35 U.S.C. 154(b) by 110 days.

(21) Appl. No.: 10/165,255

(22) Filed: Jun. 7, 2002

(51) Int. Cl.[7] ..... F01L 1/34

(52) U.S. Cl. ..... 123/90.16; 123/90.15; 123/90.39; 123/90.44

(58) Field of Search ..... 123/90.15, 90.16, 123/90.17, 90.39, 90.41, 90.42, 90.43, 90.44, 90.46

(56) References Cited

U.S. PATENT DOCUMENTS

| | | | | |
|---|---|---|---|---|
| 4,724,822 A | 2/1988 | Bonvallet | ..... | 123/90.16 |
| 5,373,818 A | 12/1994 | Unger | ..... | 123/90.16 |
| 5,666,913 A | 9/1997 | Gustafson et al. | ..... | 123/90.16 |
| 5,937,809 A | 8/1999 | Pierik et al. | ..... | 123/90.16 |
| 6,041,746 A | 3/2000 | Takemura et al. | ..... | 123/90.16 |
| 6,123,053 A | 9/2000 | Hara et al. | ..... | 123/90.16 |
| 6,295,958 B2 * | 10/2001 | Pierik | ..... | 123/90.16 |
| 6,386,162 B2 * | 5/2002 | Himsel | ..... | 123/90.15 |

* cited by examiner

*Primary Examiner*—Thomas Denion
*Assistant Examiner*—Jaime Corrigan
(74) *Attorney, Agent, or Firm*—L. J. Kasper

(57) ABSTRACT

A valve control system for controlling both the amount of valve lift (FIG. 7B) and the timing of the valve lift (FIG. 7A) of an internal combustion engine poppet valve (19). The system includes a rocker arm (37) having an engagement surface (69) and a cam member (51) disposed for to and fro movement relative to a camshaft (27) and having a cam surface (71) in generally face-to-face relationship to the engagement surface (69). A first cam follower (55) engages the cam profile (29) on the camshaft, and a second cam follower (61,70) is disposed between the engagement surface (69) and the cam surface (71), and is connected to the first cam follower (55) by a rigid follower linkage (59). A control arrangement (63) changes the to and fro position of the cam member (51) to vary valve lift, and an adjustable timing linkage (57) moves the first cam follower, to advance or retard the valve timing.

9 Claims, 6 Drawing Sheets

FULLY VARIABLE VALVE TRAIN

BACKGROUND OF THE DISCLOSURE

The present invention relates to valve control systems for internal combustion engine poppet valves, and more particularly, to such valve control systems which are capable of controlling the amount of the valve lift, the timing of the valve lift, and the duration of the valve event (valve lift).

As is well know to those skilled in the internal combustion engine art, conventional camshaft and rocker arm type valve gear trains are relatively simple and have been generally effective in commercial use. However, the conventional camshaft actuated valve gear train has typically represented a compromise in regard to engine performance. At relatively low speeds, the engine poppet valves open more than is needed (thus resulting in pumping energy losses), while at relatively higher engine speeds, the valves do not open enough to get the flow quantity of air-fuel mixture necessary to achieve optimum engine performance.

In addition, it is now understood that engine efficiency can be improved by varying the timing of the opening and closing of the poppet valves as a function of engine speed, and also as a function of load on the engine. One known method of varying the timing of the opening and closing of the engine poppet valves is by means of a variable cam phase change device ("variable cam phaser". The function of such a cam phaser device is to vary the angular position of the camshaft, relative to the angular position of the crankshaft.

Those skilled in the valve gear train art have, for many years, been developing various systems for variable valve actuation/variable valve timing (VVA/VVT) for modifying the amount of valve lift and/or the timing of the valve lift in valve gear trains of the type driven by a camshaft. More recently, the assignee of the present invention has developed a VVT system which is able to vary both the amount of lift and the timing of the lift simultaneously in a valve gear train having a camshaft as its input, this VVT system being illustrated and described in co-pending application U.S. Ser. No. 09/841,572, filed Apr. 24, 2001 in the name of Majo Cecur for a "Rocker Arm Device For Simultaneous Control Of Valve Lift And Relative Timing In A Combustion Engine", also assigned to the assignee of the present invention, and incorporated herein by reference.

Although the VVT system of the co-pending application appears to be a substantial improvement over the known prior art, and is able to adjust timing as much as is desired, the referenced system still has limitations whereby neither the valve lift nor the duration of the valve opening can ever go to zero.

In an effort to achieve a valve control system which is truly capable of fully variable valve train (FVVT) operation, those skilled in the art have developed various camless valve control systems in which the engine poppet valve has its opening and closing controlled directly by a valve actuator which may be electromagnetic or electro-hydraulic. Although such camless systems have certain benefits, such as infinitely variable valve lift, duration, and timing, and eliminating the frictional losses inherent in camshaft and rocker arm type valve gear train, there are still a number of disadvantages to the camless systems. By way of example only, in a typical camless system, it is necessary to provide sensors capable of sensing the position of the engine poppet valve and providing a feedback signal to control the operation of the electrical/electronic portion of the valve actuator.

The sensors capable of performing the function just described are not yet commercially available, but even if they were, the requirement for such sensors would add substantially to the overall cost and complexity of the typical camless valve control system.

Another problem associated with the conventional camshaft and rocker arm type of valve gear trains is the need to provide "ramps" to finely control the speed of the opening and closing of the engine poppet valve. Such ramps are typically provided by grinding an appropriate shape on the cam profile of the camshaft, at both the beginning and end of the lift profile. Unfortunately, the accurate grinding of a pair of such shapes for each cam lobe adds substantially to the overall manufacturing cost of the camshaft.

BRIEF SUMMARY OF THE INVENTION

Accordingly, it is an object of the present invention to provide a valve control system for an engine poppet valve which is capable of achieving fully variable valve train operation.

It is a more specific object of the present invention to provide such a valve control system in which both the valve lift and the timing of the valve lift may be controlled simultaneously, but independently of each other.

It is an even more specific object of the present invention to provide a valve control system of the type which achieves the above-stated objects in which the valve lift may be varied anywhere between a maximum lift and a theoretical zero lift; the duration of the lift may be varied anywhere between a maximum duration and a theoretical zero duration; and the timing of the valve opening and closing may be varied as desired to achieve optimum engine performance.

The above and other objects of the invention are accomplished by the provision of a valve control system for an internal combustion engine of the type including a cylinder head, an engine poppet valve, and a valve actuating camshaft defining a cam profile. The valve control system comprises a rocker arm having a first portion fixed to pivot relative to the cylinder head and a second portion operable to transmit cyclic opening and closing motion to the engine poppet valve. A cam follower assembly includes a first cam follower member in engagement with the cam profile whereby cyclic rise and fall motion is transmitted from the cam profile to the cam follower assembly in response to rotation of the camshaft.

The improved valve control system is characterized by a cam member disposed for to and fro movement relative to the camshaft and defining a cam surface disposed in a generally face-to-face relationship to an engagement surface defined by the rocker arm. The cam follower assembly includes a second cam follower member in operable engagement with both the engagement surface defined by the rocker arm and the cam surface defined by the cam member, and being disposed therebetween. The cam follower assembly further includes a rigid follower linkage interconnecting the first and second cam follower members, thus transmitting the cyclic rise and fall motion to the second cam follower member. An arrangement includes a link member having one end fixed relative to the cam member and the other end operably associated with an input member to vary the to and fro position of the cam member. An adjustable timing linkage has one end fixed to the first cam follower member and is operable, in response to a timing input motion, to advance or retard the point of contact of the first cam follower member on the cam profile.

DETAILED DESCRIPTION OF THE PREFERRED EMBODIMENT

Figure 1:
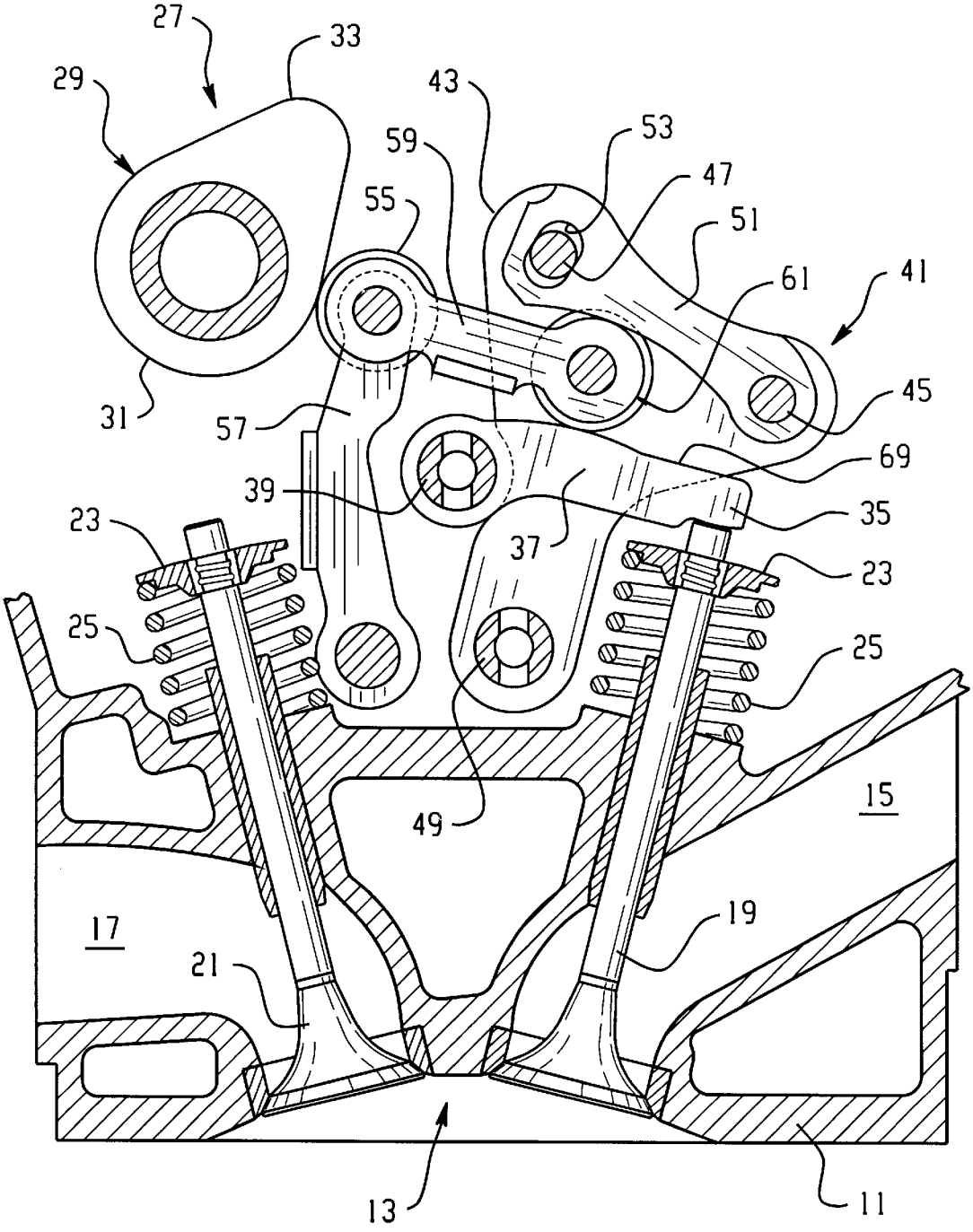
FIG. 1 is a somewhat simplified, transverse cross-section illustrating an internal combustion engine cylinder head including the valve control system of the present invention.

Referring now to the drawings, which are not intended to limit the invention, FIG. 1 illustrates a valve control system, made in accordance with the present invention, for use in controlling an engine poppet valve of an internal combustion engine. It should be noted that FIG. 1 illustrates only the cylinder head and the valve gear train of the present invention, but does not include any portion of the engine cylinder block.

The valve control system as shown in FIG. 1 includes a cylinder head 11 defining an upper portion 13 of a combustion chamber, the rest of which would be defined by the cylinder and piston. The cylinder head 11 defines an intake passage 15 and an exhaust passage 17. The flow of air-fuel mixture and combustion gasses respectively to and from the combustion chamber 13 is accomplished by means of a pair of engine poppet valves, including an intake valve 19 and an exhaust valve 21, respectively.

Each of the engine poppet valves 19 and 21 is supported for reciprocable movement relative to the cylinder head 11 between a closed position (shown in FIG. 1) and an open position, to be illustrated and described subsequently. The upper end of each of the poppet valves includes a spring retainer 23, against which is seated a valve return spring 25, which biases the respective poppet valve 19 or 21 to the closed position shown in FIG. 1.

In a manner well know to those skilled in the art, a camshaft 27 is fixed, relative to the cylinder head 11, for rotation about its axis. The camshaft 27 defines a plurality of cam profiles 29 (only one of which is shown in FIG. 1), each cam profile 29 including a base circle portion 31 and a lift portion 33. It will be understood by those skilled in the art that the lift portion 33 of the cam profile 29 is, in the subject embodiment, designed for the maximum amount of lift desired, and for the maximum duration of lift desired.

Figure 6:
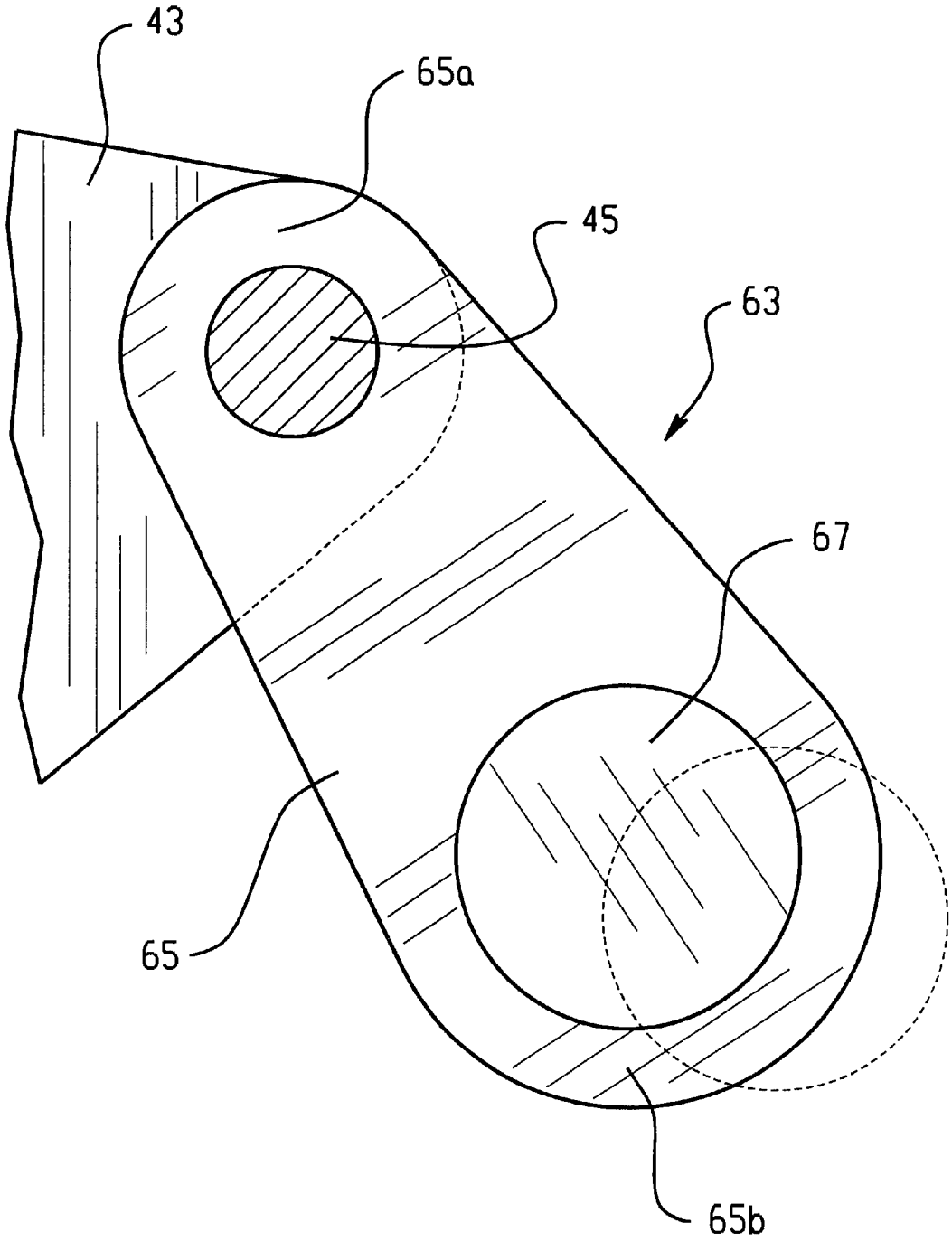
FIG. 6 is a transverse view, similar to FIGS. 1, 4 and 5, illustrating one means of varying the position of the cam assembly.

The valve control system of the present invention preferably operates in a manner to provide, selectively, either the maximum lift and duration, as determined by the configuration of the lift portion 33, or something less than the maximum lift and duration, all the way down to a minimum lift (or duration), corresponding to what is illustrated in FIG. 6. It will be understood by those skilled in the engine art that the minimum lift corresponds to an ideal idle speed condition. As noted previously, the valve control system of the present invention has, as one of its aspects, the capability of reducing the lift and duration to the minimum and furthermore, has the capability of varying timing of the poppet valve opening and closing, and doing so independently of the variations in the lift and duration.

Referring still primarily to FIG. 1, it should be noted that the valve control system of the present invention is utilized to control only the intake valve 19, and provide the intake valve 19 with the "fully variable valve train" capability, whereas in the subject embodiment, the exhaust valve 21 is operated in a conventional "fixed" valve timing relationship relative to its respective cam profile. If the engine were, for example, an in-line 4-cylinder engine, the FVVT mechanism shown in FIGS. 1 through 3 would be present on the intake valve 19 of each of the 4 cylinders, and all four of the FVVT mechanisms would, typically, be controlled in unison. In other words, at any given point in time, each of the four FVVT mechanisms would be in exactly the same condition, or operational position. Obviously, however, the lift portions 33 of the four different cam profiles 29 would be in four different positions, relative to each other.

The upper end of the stem of the intake valve 19 is in engagement with a valve pad 35 formed at the reciprocable end of a rocker arm 37. The rocker arm 37 includes an annular portion 38 (see FIG. 4) which pivots about a cylindrical support member 39, which is fixed relative to the cylinder head 11. Disposed on axially opposite sides (see FIG. 3) of the rocker arm 37 is a cam assembly, generally designated 41, which preferably includes a pair of generally V-shaped end plates 43, which are attached to each other by means of a pair of cylindrical connectors 45 and 47. Toward the bottom portion (as viewed in the drawing figures) of the V-shaped end plates 43 there is another cylindrical support member 49 fixed relative to the cylinder head 11, and thus providing a pivot location about which the cam assembly 41 pivots, in a manner to be described subsequently. Disposed between the pair of end plates 43 is a pair of cam members 51, each of which has one end fixed to rotate about the cylindrical connector 45. However, the opposite end of each of the cam members 51 can have a limited range of up and down movement relative to the cylindrical connector 47 because the cam members 51 define slightly elongated openings 53, through which the connector 47 passes.

Figure 2:
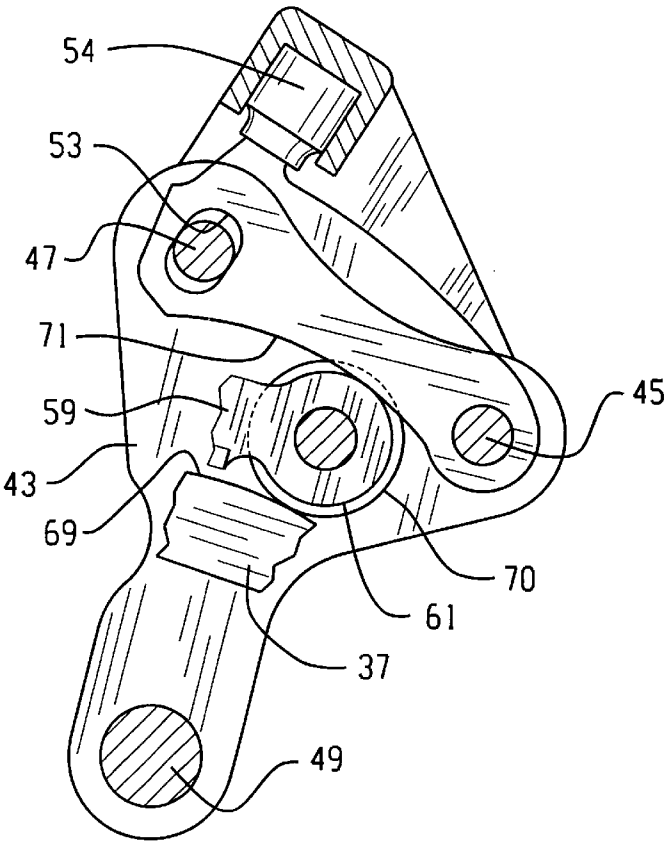
FIG. 2 is a transverse view similar to FIG. 1, but with certain parts shown only fragmentarily, to illustrate further the cam assembly which comprises one aspect of the present invention.

The arrangement described permits the cam assembly 41 to include a hydraulic lash compensation device 54, shown only in FIG. 2, and by way of example only. Preferably, the lash compensation device 54 would include some sort of mechanical "lift loss" capability of the general type which is now well known to those skilled in the lash compensation art. However, it should be understood that the provision of lash compensation in the valve control system of the invention is preferred, but not essential, and therefore, the particular type of lash compensator and its specific location within the system are also not essential features of the invention.

In engagement with the cam profile 29 is a cam follower 55, which is fixed to rotate relative to an upper end 56 of an adjustable timing linkage 57 (see FIG. 4), which will be described in greater detail subsequently. Also fixed to pivot relative to the cam follower 55 is a generally rigid follower linkage 59 which projects between the end plates 43, and includes, at its right end in FIG. 1, a pair of second cam followers 61, the function of which will also be described subsequently. As will be understood by those skilled in the engine art, from a reading and understanding of the remainder of this specification, the timing linkage 57 moves in a generally vertical direction, in response to an input from the engine ECU. This input may be generated using the same engine and vehicle parameters as would be used to generate the input used to control a variable cam phaser, in view of the fact that the vertical movement of the linkage 57 accomplishes the same function and purpose as rotating the camshaft relative to the crankshaft.

As may best be seen in FIG. 6 (but not shown in FIGS. 1, 4 and 5, for simplicity) there is, attached to the cylindrical connector 45, an eccentric link arrangement, generally designated 63, including an eccentric link member 65. The link member 65 has one end 65*a* pivotably disposed about the cylindrical connector 45 and its opposite end 65*b* associated with an eccentric actuator 67, whereby a rotational input motion may be provided to the arrangement 63 (for example, in response to movement of the vehicle accelerator pedal). Specifically, rotational input motion to the eccentric actuator 67 results in longitudinal motion of the eccentric link member 65, thus pivoting the cam assembly 41 about its pivot location (i.e., the cylindrical support member 49).

Figure 4:
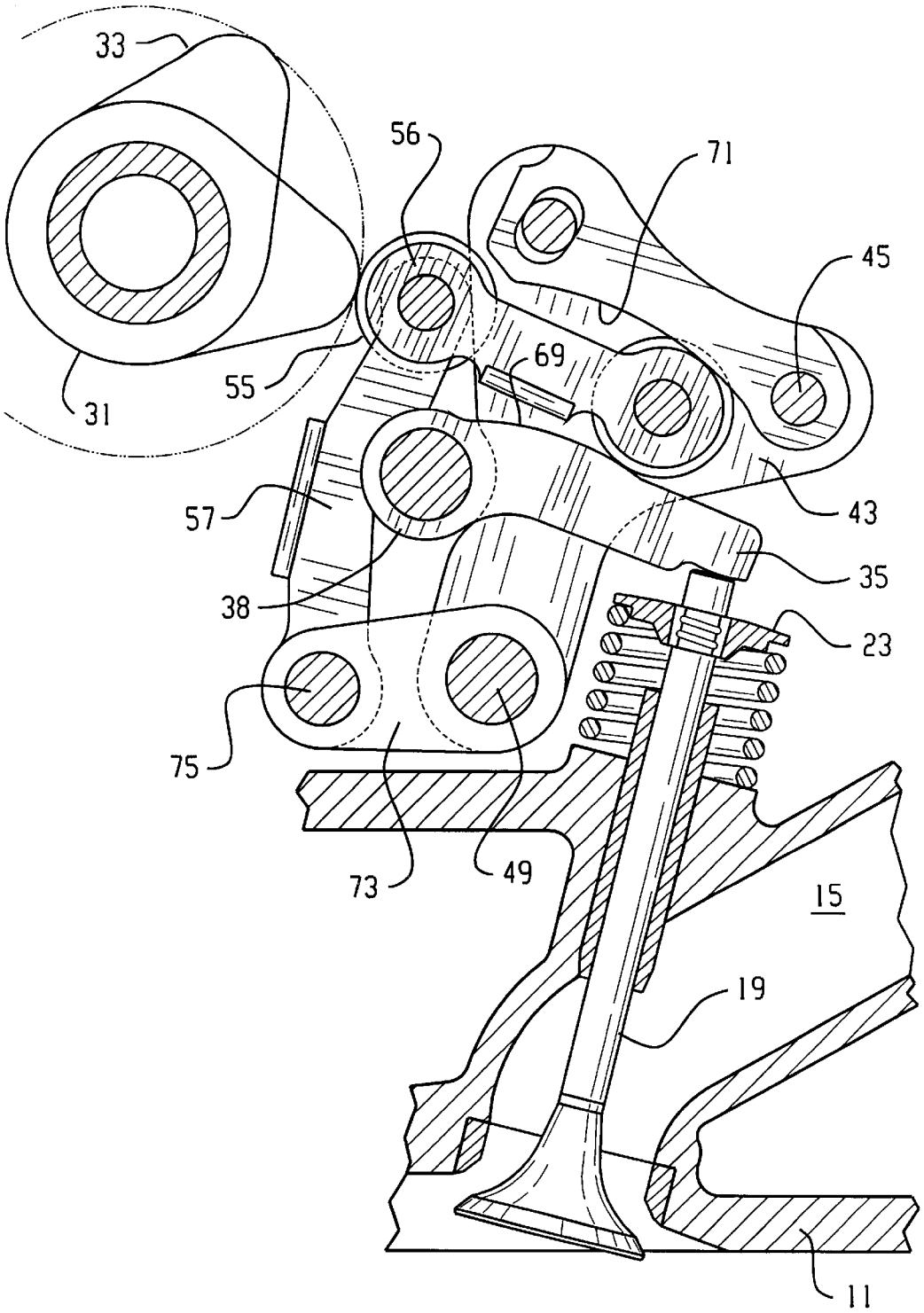
FIG. 4 is a fragmentary, transverse cross-section, similar to FIG. 1, with the camshaft rotated to the maximum lift portion of the cam profile, and the engine poppet valve at maximum lift.
Figure 5:
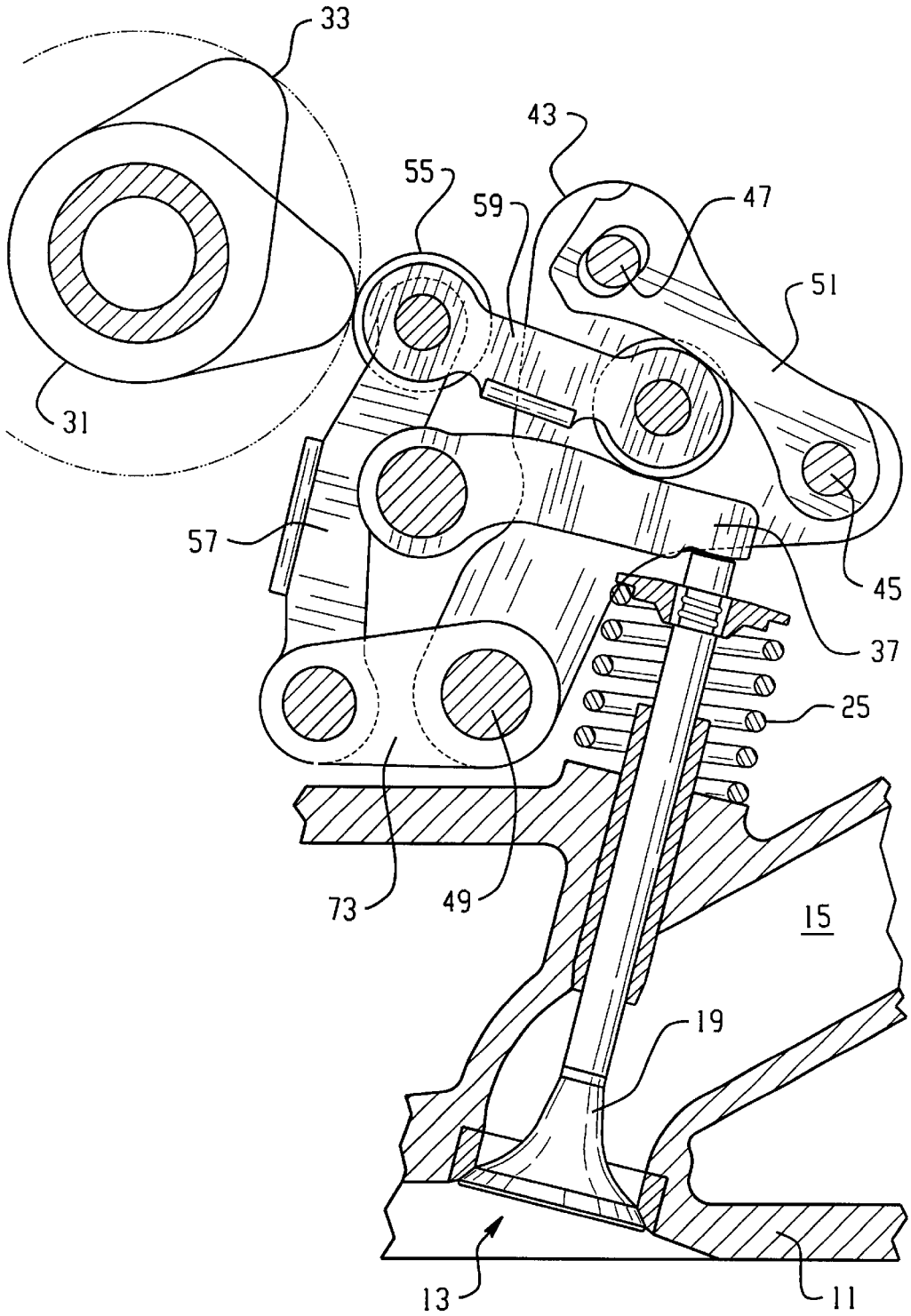
FIG. 5 is a fragmentary, transverse cross-section, similar to FIG. 4, but with the engine poppet valve now in a minimum lift condition.
Figure 7A:
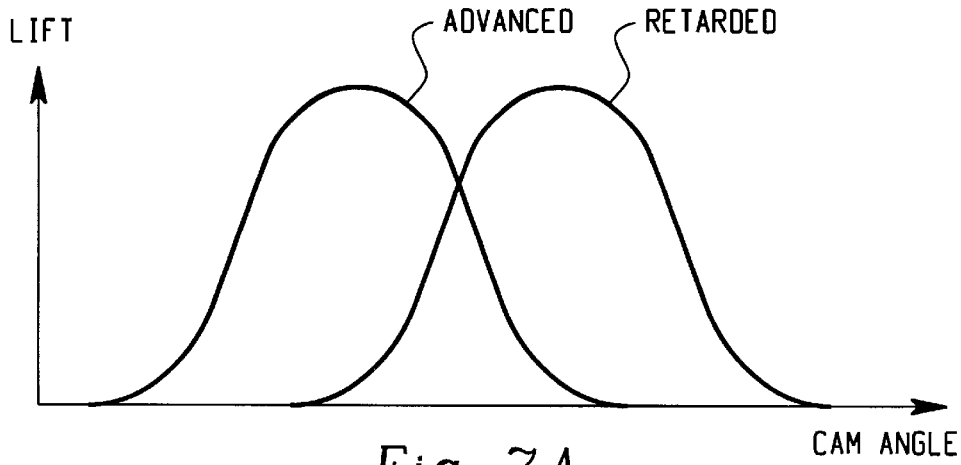
FIGS. 7A, 7B, and 7C are graphs of valve lift as a function of time, or more precisely, as a function of rotational position of the camshaft.
Figure 7B:
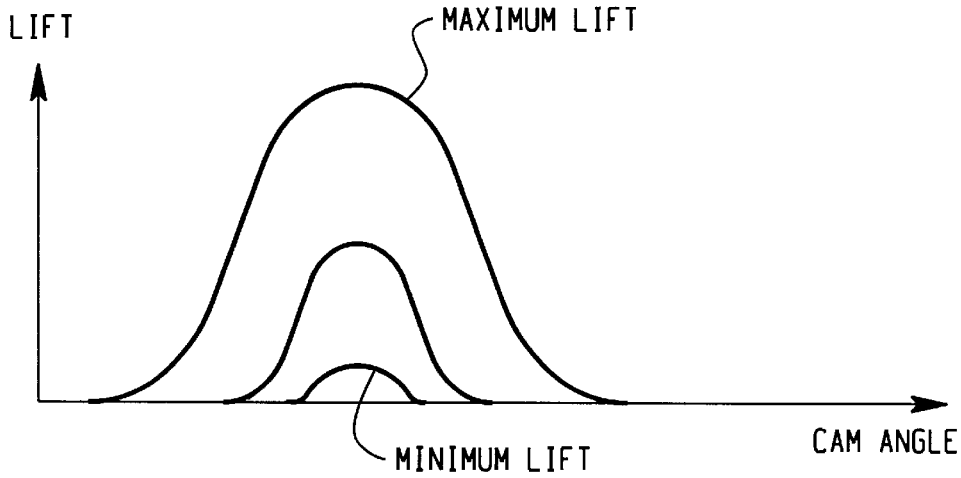

In accordance with the subject embodiment, and by way of example only, as the eccentric actuator 67 rotates over a range of about 600 of rotation, the cam assembly 41 is pivoted between the extreme positions shown in FIGS. 4 and 5, corresponding, respectively, to a maximum lift condition ("MAX. LIFT" in FIG. 7B) and a minimum lift condition ("MIN. LIFT" in FIG. 7B). It may be seen in FIG. 7B, by comparing the various lift graphs, that lift duration is generally proportional to lift amplitude, and that both are directly proportional to the angle of the cam assembly 41, as it is moved from the minimum lift condition of FIG. 5 to the maximum lift condition of FIG. 4.

Figure 3:
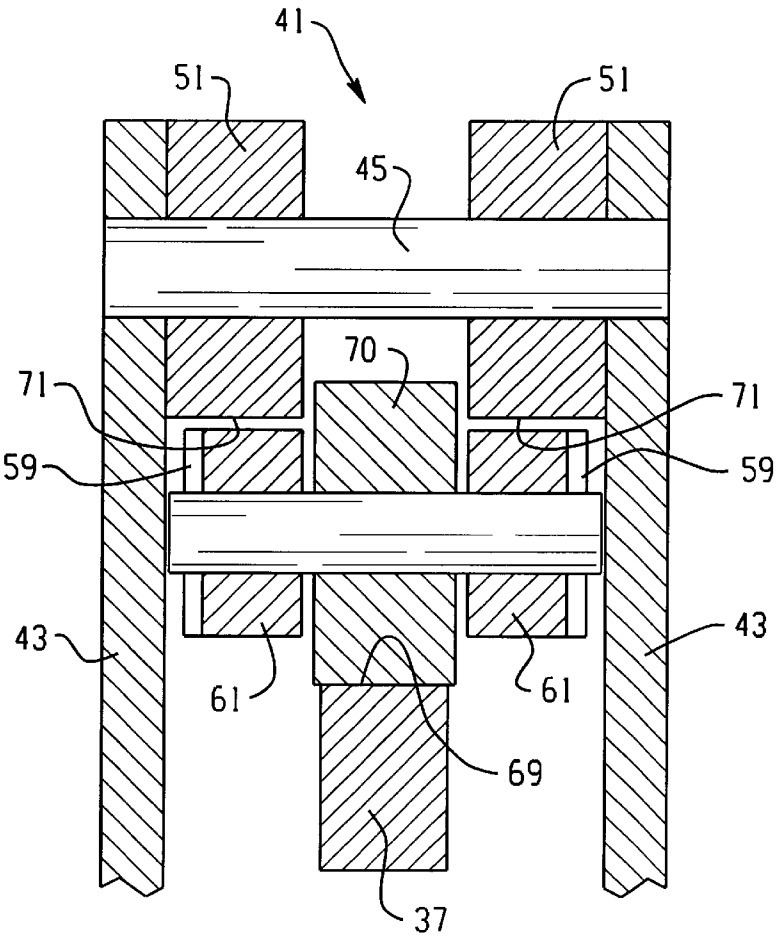
FIG. 3 is an axial cross-section, taken through FIG. 2, and illustrating the cam assembly which comprises one aspect of the present invention.

Referring now primarily to FIGS. 2 and 3, in conjunction with FIG. 1, the rocker arm 37 defines an upper (in the orientation of FIG. 1) engagement surface 69 which is in engagement with a roller cam follower 70, disposed between the pair of second cam followers 61. Similarly, the cam members 51 define, on their undersides, cam surfaces 71 which are in engagement with the second cam followers 61. As was mentioned in the BACKGROUND OF THE DISCLOSURE, the need to grind a pair of very accurate surfaces on the cam profile, to provide the valve opening and closing "ramps" is a primary reason for the typical camshaft being very expensive. In accordance with an important benefit of the present invention, the desired valve opening and closing curve, including the "ramps", is provided in the forming of the cam surface 71 and, because that surface is traversed twice during each valve event (opening + closing), only one accurately formed portion to define the ramps must be provided. As a result, the cam profile 29 may remain as a "net shape", thus making the camshaft substantially less expensive.

Referring now primarily to FIGS. 4 and 7, the variable valve timing portion of the system will be described. A linkage member 73 is provided, having one end (right end in FIG. 4) fixed to rotate with the cylindrical support member 49, about which the cam assembly 41 pivots. The other end of the linkage member 73 is pivotally connected by a cylindrical member 75 to the adjustable timing linkage 57. Therefore, the support member 49 serves two functions, first, as the pivot location for the cam assembly 41 and, second, as the input to control the system timing. Those skilled in the art will understand that rotation of the support member 49, to control valve timing, may be accomplished in any one of several ways, such as by means of a rotary solenoid, such input to the member 49 not comprising part of the invention. When variations in the desired timing are provided to the system in the form of rotation of the support member 49, the linkage member 73 pivots about the axis of the member 49, either raising or lowering the linkage 57, depending upon the direction of rotation of the support member 49.

With the position of the linkage member 73, as shown in FIG. 4, comprising the "normal" timing (corresponding to the timing shown in FIG. 7B), and assuming clockwise rotation of the camshaft 27, rotation of the support member 49 clockwise will raise the timing linkage 57. As a result, the lift portion 33 of the cam profile 29 will engage the cam follower 55 sooner, thus producing the "ADVANCED" timing shown in FIG. 7A. If, on the other hand, the support member 49 were rotated in the counter-clockwise direction, the timing linkage 57 would be lowered. As a result, the lift portion 33 would engage the cam follower 55 later than "normal", thus producing the "RETARDED" timing shown in FIG. 7A.

Figure 7C:
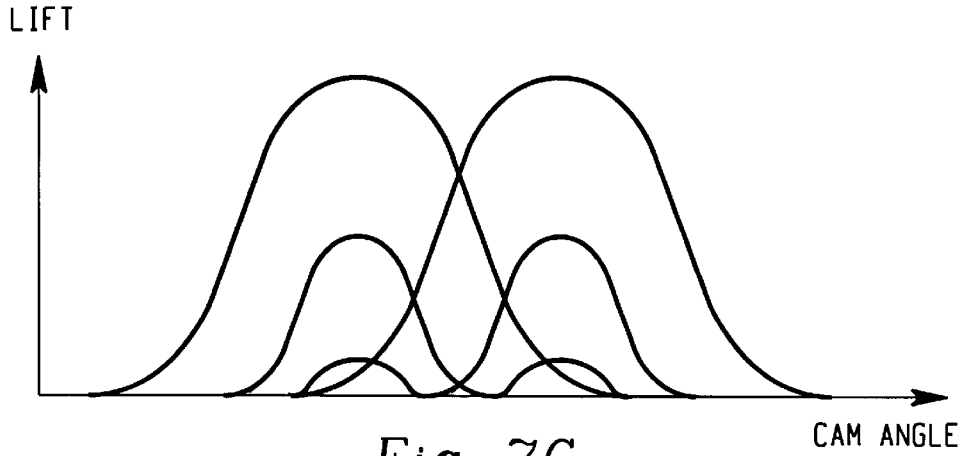

Referring now to FIG. 7C, it should be apparent to those skilled in the art, from a careful reading and understanding of the foregoing specification, that, because the support member 49 (timing control member) and the eccentric actuator 67 can be controlled independently of each other, any desired combination of valve lift and valve timing is possible with the present invention. In other words, the valve lift can be varied anywhere between the MIN. LIFT and MAX. LIFT conditions shown in FIG. 7B, while the valve timing can be varied anywhere between the ADVANCED timing and the RETARDED timing shown in FIG. 7A. Furthermore, unlike many prior art systems, it is possible to achieve any of the possible valve lifts in combination with any of the possible valve timings. There is no predetermined set of possible combinations whereby certain valve lift amounts correspond to only certain valve timing conditions, or vice versa.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A valve control system for an internal combustion engine of the type including a cylinder head, an engine poppet valve, and a valve actuating camshaft defining a cam profile; said valve control system comprising a rocker arm having a first portion fixed to pivot relative to said cylinder head and a second portion operable to transmit cyclic opening and closing motion to said engine poppet valve; a cam follower assembly including a first cam follower member in engagement with said cam profile, whereby cyclic rise and fall motion is transmitted from said cam profile to said first cam follower member in response to rotation of said camshaft; characterized by:

(a) a cam member disposed for to and fro movement relative to said camshaft and defining a cam surface disposed in a generally face-to-face relationship to an engagement surface defined by said rocker arm;

(b) said cam follower assembly including a second cam follower member in operable engagement with both said engagement surface defined by said rocker arm and said cam surface defined by said cam member, and being disposed therebetween, said cam follower assembly further including a rigid follower linkage interconnecting said first and second cam follower members, thus transmitting said cyclic rise and fall motion to said second cam follower member;

(c) a control arrangement including a link member having one end (65*a*) fixed relative to said cam assembly and the other end operably associated with an input member to vary the to and fro position of said cam member; and (d) an adjustable timing linkage having one end fixed to said first cam follower member and operable, in response to a timing input motion, to advance or retard the point of contact of said first cam follower member on said cam profile.

2. A valve control system as claimed in claim 1, characterized by said engine poppet valve comprises an intake valve.

3. A valve control system as claimed in claim 1, characterized by said first portion of said rocker arm comprises an end of said rocker arm disposed oppositely from said second portion of said rocker arm.

4. A valve control system as claimed in claim 1, characterized by said second cam follower comprises one cam follower in operable engagement with said engagement surface of said rocker arm and another cam follower in operable engagement with said cam surface of said cam member, at least one of said cam followers being free to rotate relative to said rigid follower linkage.

5. A valve control system as claimed in claim 1, characterized by each of said first and second cam follower members comprises a roller, each having its axis of rotation fixed relative to said rigid follower linkage.

6. A valve control system as claimed in claim 1, characterized by said cam follower assembly comprising a generally V-shaped member having a pivot location disposed generally toward the lower portion of said V-shaped member, said one end of said link member of said control arrangement being fixed to said V-shaped member toward an upper portion thereof, and said to and fro movement of said cam member (51) comprises pivotal movement about said pivot location (49).

7. A valve control system as claimed in claim 6, characterized by said cam member and said cam surface being disposed toward said upper portion of said generally V-shaped member.

8. A valve control system as claimed in claim 1, characterized by said one end of said link member having an axis fixed relative to said cam assembly, said link member being moveable relative to said cam assembly, said input member being mounted to be eccentric relative to a rotatable actuator shaft, whereby rotation of said actuator shaft results in said to and fro movement of said cam follower assembly and generally parallel, linear movement of said cam surface relative to said engagement surface of said rocker arm and said second cam follower member.

9. A valve control system as claimed in claim 1, characterized by said cam follower assembly having a pivot location comprising a generally cylindrical support member, said adjustable timing linkage including means operable, in response to said timing input motion being transmitted to rotate said support member, to convert said rotation of said support member (49) into linear motion of said timing linkage (57).

* * * * *